US011841181B2

(12) United States Patent
Hosamani et al.

(10) Patent No.: US 11,841,181 B2
(45) Date of Patent: Dec. 12, 2023

(54) ICE MAKER AND HOUSEHOLD REFRIGERATION APPARATUS

(71) Applicant: BSH HAUSGERAETE GMBH, Munich (DE)

(72) Inventors: Prashantagouda Hosamani, Ulm (DE); Robert Stahl, Herbrechtingen (DE); Mathias Sigl, Herbrechtingen (DE); Jorge Carlos Montalvo Sanchez, Knoxville, TN (US)

(73) Assignee: BSH Hausgeraete GmbH, Munich (DE)

( * ) Notice: Subject to any disclaimer, the term of this patent is extended or adjusted under 35 U.S.C. 154(b) by 338 days.

(21) Appl. No.: 16/884,264

(22) Filed: May 27, 2020

(65) Prior Publication Data

US 2020/0284490 A1 Sep. 10, 2020

Related U.S. Application Data

(63) Continuation-in-part of application No. 16/203,026, filed on Nov. 28, 2018, now Pat. No. 11,209,201.

(51) Int. Cl.
*F25C 5/20* (2018.01)
*F25C 1/24* (2018.01)

(52) U.S. Cl.
CPC ..... *F25C 5/22* (2018.01); *F25C 1/24* (2013.01); *F25C 5/24* (2018.01); *F25C 2400/10* (2013.01)

(58) Field of Classification Search
CPC ..... F25C 5/20; F25C 5/22; F25C 5/24; F25C 1/24; F25C 2400/10
See application file for complete search history.

(56) References Cited

U.S. PATENT DOCUMENTS

| | | | | |
|---|---|---|---|---|
| 3,807,193 | A * | 4/1974 | McKenney | F25C 5/20 141/82 |
| 6,135,173 | A * | 10/2000 | Lee | F25C 5/22 141/351 |
| 6,880,355 | B2 | 4/2005 | Jung | |
| 2015/0300718 | A1* | 10/2015 | Bauriedl | F25C 5/22 222/173 |
| 2021/0048235 | A1* | 2/2021 | Bauriedl | F25C 5/22 |

* cited by examiner

*Primary Examiner* — Tavia Sullens
(74) *Attorney, Agent, or Firm* — Laurence A. Greenberg; Werner H. Stemer; Ralph E. Locher

(57) ABSTRACT

An ice maker for a household refrigeration apparatus includes a housing with an opening through which ice is dispensable from an interior of the housing out of the housing. A crushing device for crushing ice is provided at the opening. A flap is movably disposed at the opening and switchable between a closed position for dispensing crushed ice and an opened position for dispensing uncrushed ice through the opening. A drive unit is coupled to the flap by a coupling device for moving the flap. The flap has a pivot axis about which the flap pivots and a first flap arm coupled to the coupling device and a second flap arm movable relative to the opening, extend radially away from the pivot axis. A household refrigeration apparatus includes an apparatus housing having a receiving space for food, and an ice maker.

18 Claims, 13 Drawing Sheets

ICE MAKER AND HOUSEHOLD REFRIGERATION APPARATUS

CROSS-REFERENCE TO RELATED APPLICATION

This application is a Continuation-In-Part of patent application Ser. No. 16/203,026 filed Nov. 28, 2018; the prior application is herewith incorporated by reference in its entirety.

BACKGROUND OF THE INVENTION

Field of the Invention

An aspect of the invention relates ice maker comprising a specifically constructed flap adjustable into a closed position for dispensing of crushed ice and into an opened position for dispensing of uncrushed ice. A further aspect relates to a household refrigeration apparatus comprising such an ice maker.

Household refrigeration apparatuses are known in diverse configurations. In this context, it is also known that an interior container bounds a receiving space for a household refrigeration apparatus. This receiving space is usually a refrigerating compartment. A partial area is occupied by an ice maker in this receiving space. Thereto, it is known that the ice maker is separated from the remaining volume of the refrigerating compartment. In this context, it is provided that a housing area of the housing of the ice maker is formed by a separate wall element, which is attached to inner sides of walls of the interior container in the interior of the receiving space of the interior container.

From U.S. Pat. No. 6,880,355 B2, a household refrigeration apparatus with an ice maker is known. The ice maker occupies a partial area of the interior volume of a refrigerating compartment, which is a receiving space for food. The ice maker comprises a housing. A drive unit is arranged in this housing, by which a control means is to be actuated. An outlet of the housing is closed or opened by the control means. Ice can be output from the ice maker via this outlet. In the configuration of the ice maker, it is provided that this drive unit is arranged at the rearmost end of the housing viewed in depth direction of the household refrigeration apparatus. However, the control means is arranged at the frontmost end, where the opening is also formed. Thereby, it is required in this configuration to bridge a relatively long path, namely the entire length of this housing of the ice maker measured in depth direction, to provide a mechanical coupling between the drive unit and this control means. In this respect, it is provided that a thin rod drive is formed, which extends over this entire distance. Thereto, this relatively thin and delicate rod is mechanically fixed or suspended at multiple locations. Due to the different positions of the components, it comprises multiply bent areas to be able to allow the mechanical coupling to the drive unit on the one and to the control means on the other hand anyway. Therefore, the coupling distance is formed by a very long element, namely this connecting rod. By such a configuration, however, disadvantages exist to the effect that more space is required, movement transmission from the drive unit to the control means is very inaccurately effected on the other hand. Here, tolerances are given by the large path distance, by which the precision of the movement transmission, which is generated by the drive unit, and is then performed by the control means, is restricted and deviating, respectively. This also results in the fact that the movement of the control means becomes inaccurate and an open position or a closed position of this control means is only achieved to a limited extent. Thereby, problems in passing the ice can occur on the one hand, on the other hand, if this control means is not completely opened, jam of ice in the opening not completely unblocked can occur. Moreover, a loss of stability is also associated with this very thin and delicate connecting rod. This means that the long rod can also deform in itself, for example bend or twist, upon force effect by the drive unit. Thereby too, an insufficient and not complete or not direct transmission of the movement initiated by the drive unit to this control means can be effected. In the configuration of the ice maker from the prior art, a very expensive assembly process is also required due to the plurality of components and the individual positions.

BRIEF SUMMARY OF THE INVENTION

It is an object of the present invention to provide an improved ice maker. Similarly, it is an object of the invention to provide a household refrigeration apparatus with such an ice maker.

This object is solved by an ice maker, a household refrigeration apparatus according to the independent claims.

An aspect relates to an ice maker for a household refrigeration apparatus, comprising a housing with an opening through which ice is dispensable from an interior of the housing out of the housing, a crushing device for crushing of ice provided at the opening, a flap movably arranged at the opening and switchable between a closed position for dispensing of crushed ice and an opened position for dispensing of uncrushed ice through the opening, a drive unit coupled to the flap by a coupling device for moving the flap, and wherein the flap having a pivot axis about which the flap pivots and from the pivot axis extends radially away a first flap arm which is coupled to the coupling device and a second flap arm which is movable relative to the opening.

A further aspect relates to a household refrigeration apparatus comprising an apparatus housing with a receiving space for food, and an ice maker for a household refrigeration apparatus, comprising a housing with an opening through which ice is dispensable from an interior of the housing out of the housing, a crushing device for crushing of ice provided at the opening, a flap movably arranged at the opening and switchable between a closed position for dispensing of crushed ice and an opened position for dispensing of uncrushed ice through the opening, a drive unit coupled to the flap by a coupling device for moving the flap; and wherein the flap having a pivot axis about which the flap pivots and from the pivot axis extends radially away a first flap arm which is coupled to the coupling device and a second flap arm which is movable relative to the opening.

Another aspect of the present disclosure are disclosed in the dependent claims.

According to another aspect of the present disclosure, the first flap arm extends above of the crushing device in width direction of the ice maker and the second flap arm extends adjacent to the crushing device in height direction of the ice maker.

According to another aspect of the present disclosure, the first flap arm and the second flap arm is formed in one part.

According to another aspect of the present disclosure, the pivot axis is arranged above the crushing device.

According to another aspect of the present disclosure, the coupling device having a coupling rod which connects the flap and the drive unit and the coupling rod protrudes through a wall of a front cover of the ice maker.

According to another aspect of the present disclosure, wherein the flap having an engagement slit at a first end portion of the first flap arm and in the engagement slit engages the coupling device.

According to another aspect of the present disclosure, an end part of the coupling rod is movable along the engagement slit.

According to another aspect of the present disclosure, the second flap arm is located inside the opening in the closed position of the flap and outside of the opening in the opened position of the flap.

According to another aspect of the present disclosure, the second flap arm having a shovel-like form and curved form.

According to another aspect of the present disclosure, the flap having a spring for returning the flap into the closed position.

According to another aspect of the present disclosure, a center portion of the spring is arranged at a rotation axis of the coupling device.

According to another aspect of the present disclosure, the spring having a first spring arm which extends radially away and downwardly from the center portion and the first spring arm is coupled with a protrusion of a wall a front cover of the ice maker.

According to another aspect of the present disclosure, the spring having a second spring arm which extends radially away and upwardly from the center portion and the second spring arm is coupled with an end part of the coupling device.

According to another aspect of the present disclosure, the spring is more tensed in the opened position than in the closed position of the flap.

According to another aspect of the present disclosure, the coupling device having a further end part that is coupled with the drive unit, and the further end part is angled away from the ice container.

According to another aspect of the present disclosure, wherein the opening and the flap is provided inside a front cover of the housing, to which the ice container is integrally formed.

According to another aspect of the present disclosure, the second flap arm is movable in and out of the opening.

According to another aspect of the present disclosure, the drive unit is formed as a separate module, wherein the entire module of the drive unit is arranged adjacent to the opening in the housing.

According to another aspect of the present disclosure, the ice container and the module of the drive unit is arranged laterally directly next to each other inside the housing.

According to another aspect of the present disclosure, the drive unit comprises a motor and an actuating element, which is coupled to the motor, wherein the actuating element is coupled to the flap.

According to another aspect of the present disclosure, the housing has a depth direction, and the opening is arranged in a front third of depth of the entire depth of the housing and the module of the drive unit is arranged in this front third of depth. Preferably, the housing has a depth direction, and the housing comprises a front flange, wherein the module is arranged adjacent to the front flange. Preferably, the housing has a depth direction, and the module is arranged in a front-side corner area of the interior of the housing with front-side view of the ice maker in this depth direction. Preferably, the module is arranged in a left lower, front-side corner area of the interior.

According to another aspect of the present disclosure, the ice maker comprises an ice container for ice form elements, wherein the ice container is arranged in the housing and the module of the drive unit is arranged laterally directly next to the ice container viewed in width direction of the ice maker.

According to another aspect of the present disclosure, the coupling device comprises a coupling rod, which is connected to the flap and to the module of the drive unit. In particular, the flap comprises an engagement slit at an end portion of the flap, with which the coupling rod engages. Preferably, the flap is formed shovel-like and curved. Preferably, the module of the drive unit comprises a module housing, which is non-destructively detachably arranged at the housing.

According to another aspect of the present disclosure, the module housing is fixed to the housing by a mechanical connection, which is a plug connection or a locking connection or a plug and locking connection. Preferably, the mechanical connection comprises at least one plug runner and one plug rail, which can be plugged together by a linear relative movement to each other.

According to another aspect of the present disclosure, the plug runner is formed integrally with the module housing and the plug rail is formed integrally with the housing.

According to another aspect of the present disclosure, the drive unit comprises a motor and an actuating element, which is coupled to the motor, wherein the actuating element is coupled to the flap.

Further features of the invention are apparent from the claims, the figures and the description of figures. The features and feature combinations mentioned above in the description as well as the features and feature combinations mentioned below in the description of figures and/or shown in the figures alone are usable not only in the respectively specified combination, but also in other combinations without departing from the scope of the invention. Thus, implementations are also to be considered as encompassed and disclosed by the invention, which are not explicitly shown in the figures and explained, but arise from and can be generated by separated feature combinations from the explained implementations. Implementations and feature combinations are also to be considered as disclosed, which thus do not comprise all of the features of an originally formulated independent claim. Moreover, implementations and feature combinations are to be considered as disclosed, in particular by the implementations set out above, which extend beyond or deviate from the feature combinations set out in the relations of the claims.

Other features which are considered as characteristic for the invention are set forth in the appended claims.

Although the invention is illustrated and described herein as embodied in an ice maker and a household refrigeration apparatus, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
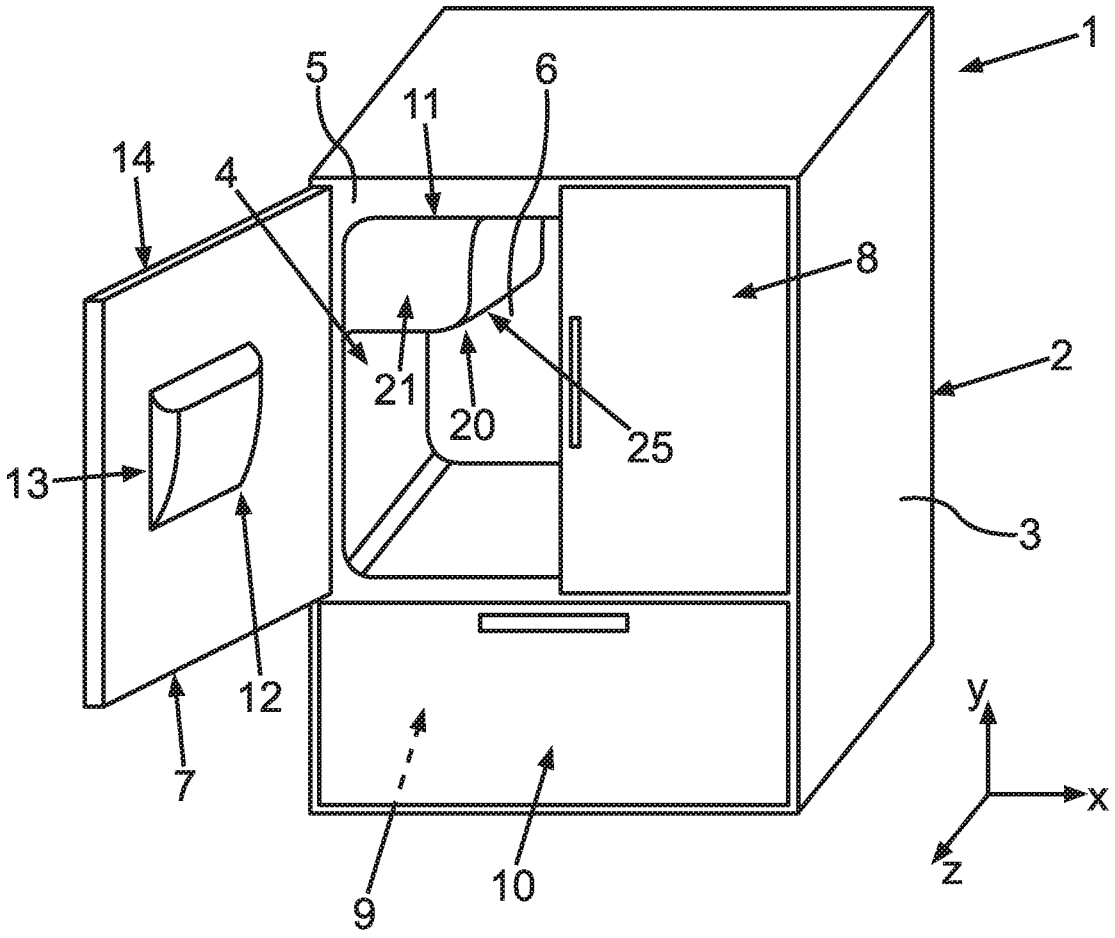
FIG. 1 is a simplified perspective representation of an embodiment of a household refrigeration apparatus according to the invention.

In the figures, identical or functionally identical elements are provided with the same reference characters.

The indications "top," "bottom," "front," "rear," "horizontal," "vertical," "depth direction," "width direction," "height direction," etc. specify the positions and orientations given in intended use and intended arrangement of the apparatus.

Referring now to the figures of the drawings in detail and first, particularly to FIG. 1 thereof, there is seen a household refrigeration apparatus 1 in a simplified representation, which is formed for storing and preserving food. The household refrigeration apparatus 1 comprises a housing 2. The housing 2 comprises an exterior housing 3. Moreover, the household refrigeration apparatus 1 comprises an interior container 4 separate from the exterior housing 3. The interior container 4 is received in the exterior housing 3. A thermally insulating material such as for example insulating foam and/or a vacuum insulating panel is arranged in a clearance 5 between the exterior housing 3 and the interior container 4.

In the embodiment, the interior container 4 bounds a receiving space 6 with its walls, which is formed for receiving food. Here, the receiving space 6 is in particular formed as a refrigerating compartment.

On the front side, the interior container 4 comprises a loading opening, via which food can be taken into or be removed from the receiving space 6. In the embodiment, the receiving space 6 is closable by two separate doors 7 and 8. The two doors 7 and 8 are pivotably arranged at the housing 2. The two doors 7 and 8 are arranged in the same height position viewed in height direction (y-direction) of the household refrigeration apparatus 1. In width direction (x-direction) of the household refrigeration apparatus 1, they are arranged next to each other such that they collectively close the receiving space 6 on the front side in the closed state. In particular, these two doors 7 and 8 are arranged in a common plane in the closed state, which is spanned by the height direction and the width direction.

In FIG. 1, the door 7 on the left side with front-side view is illustrated opened and the door 8 on the right side is illustrated closed.

Advantageously, the household refrigeration apparatus 1 comprises at least one further receiving space 9 for food. This further receiving space 9 is separated from the first receiving space 6. The further receiving space 9 can for example be a freezing compartment or a keep-fresh compartment or a further refrigerating compartment. Viewed in height direction, this further receiving space 9 is formed below the first receiving space 6. The further receiving space 9 is in particular bounded by further walls of an interior container, which can also be the interior container 4. Preferably, it is provided that the further receiving space 9 is bounded by a further door 10, which is shown in the closed state in FIG. 1. Preferably, it is provided that this door 10 is formed as a front plate of a drawer linearly retractable and extendable in depth direction (z-direction) of the household refrigeration apparatus 1.

It can be provided that the household refrigeration apparatus 1 comprises multiple, separate further receiving spaces 9, and further such explained drawers are preferably formed in this context. They can adjoin to the further receiving space 9 towards the bottom viewed in height direction. They are in particular also formed within the housing 2.

Further, the door 10, in particular this front plate, is arranged in the same plane as the doors 7 and 8 in the closed state of the doors 7, 8 and 10. In particular, the doors 7, 8 and 10 are front-side vision components of the household refrigeration apparatus 1. In particular, they are also, if they are closed, arranged without overlap with each other.

Moreover, the household refrigeration apparatus 1 comprises an ice maker 11. The ice maker 11 occupies a partial area of the volume of the receiving space 6 and is thermally insulated from the remaining volume of the receiving space 6. The ice maker 11 is formed to produce ice from water, which is supplied to the household refrigeration apparatus 1 via an external water supply line. In this context, ice form elements such as ice cubes or crushed ice can be produced.

Further, the ice maker 11 is a constituent of the dispenser unit 12 of the household refrigeration apparatus 1. In this advantageous implementation, the dispenser unit 12 comprises an output unit 13 in addition to the ice maker 11. This output unit 13 can preferably be formed at a door 7, 8. In the shown embodiment, the output unit 13 is arranged at the door 7. This is in particular advantageous because the ice maker 11 is arranged in the left upper corner area of the total volume of the receiving space 6 with front-side view of the household refrigeration apparatus 1. For outputting produced ice form elements, short paths are achieved by this local positioning. The output unit 13 is fixedly installed at the door 7. Moreover, the output unit 13 is separated from the ice maker 11 and also decoupled from it in this context. In the closed state of the door 7, ice form elements produced by the ice maker 11 can get into the output unit 13 and be output via a front side 14 of the door 7. Thereto, it is provided that a recess is formed on the front side 14, which faces away from the receiving space 6 in the closed state of the door 7. A vessel can be placed in this recess to be able to collect the output ice form elements.

Further, the dispenser unit 12 can also be formed for outputting liquid such as water or other drinks in addition to the output of ice form elements.

Figure 2:
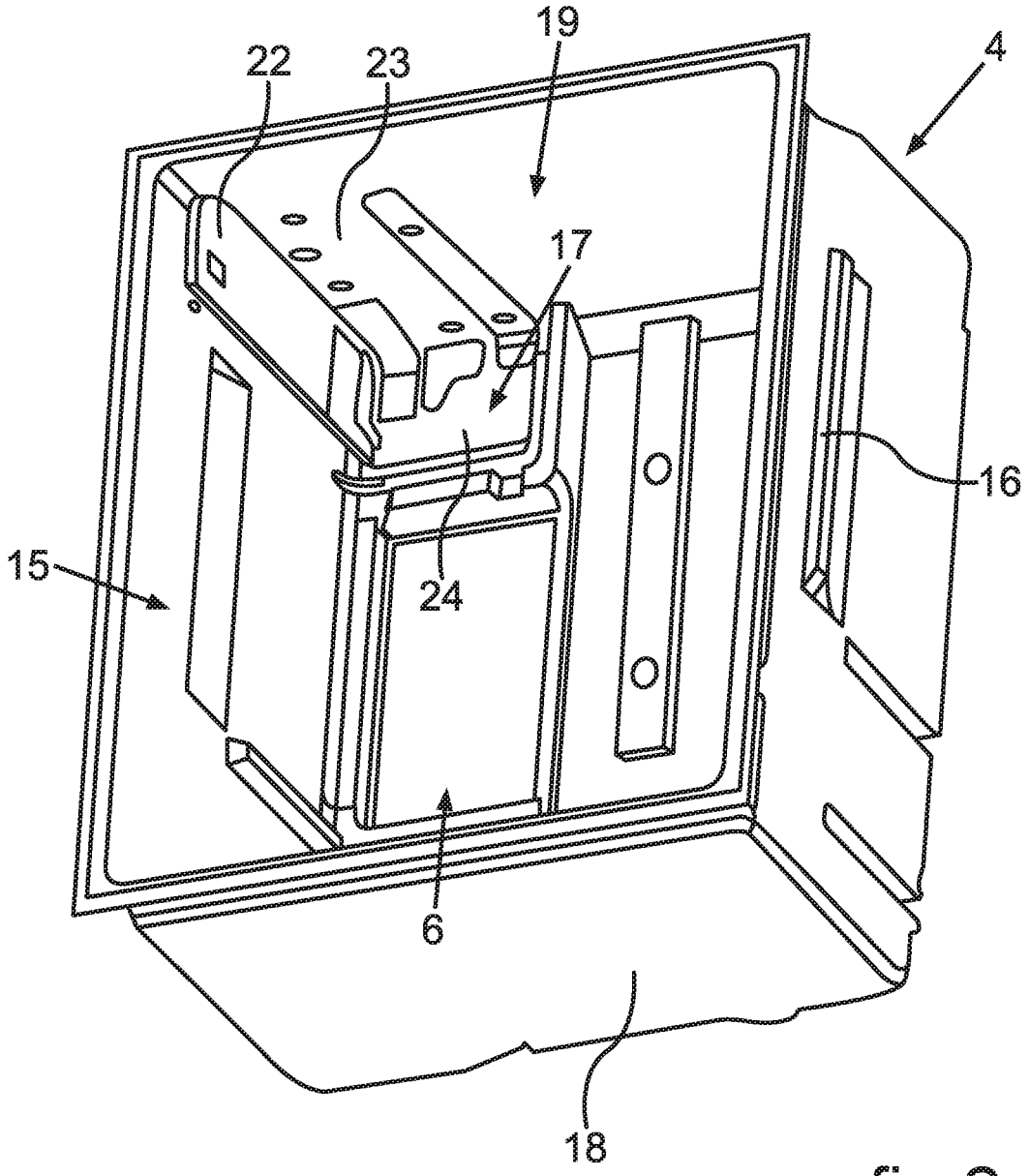
FIG. 2 is a perspective representation of an embodiment of an interior container of the household refrigeration apparatus.

In FIG. 2, an embodiment of the interior container 4 is shown in a perspective representation. The interior container 4 is preferably integrally produced from plastic, for example by deep-drawing. Injection molding can also be provided.

The interior container 4 comprises multiple walls, which bound the receiving space 6. For example, the interior container 4 is formed with a first vertical side wall, which is a first wall 15 in the example, an opposing second vertical side wall 16, a rear wall 17, which is a third wall in the example, a bottom wall 18 and a ceiling wall, which is a second wall 19 in the example.

The first vertical side wall for example represents a first wall 15 of the interior container 4. In an embodiment, the ceiling wall represents a second wall 19 of the interior container 4, which is arranged angled, in particular at an angle of 90°, to the first wall 15.

The ice maker 11 comprises a housing 20 (FIG. 1). A receiving space 21 of this ice maker 11 is bounded by the housing 20. The housing 20 comprises a wall area 22 (FIG. 2) of the first wall 15 as a constituent. This wall area 22 is an upper wall area in the configuration according to FIG. 1 and FIG. 2. Moreover, a further constituent of the housing 20 of the ice maker 11 is formed by a wall area 23 of the second wall 19.

Moreover, the receiving space 21 is bounded by a further wall area 24. This further wall area 24 is an integral constituent of the rear wall 17 of the interior container 4. The wall areas 22, 23 and 24 directly join to each other.

Moreover, the housing 20 comprises a wall unit 25 (FIG. 1), which is a component separate from the interior container 4. This wall unit 25 is a further constituent of the housing 20 and bounds the receiving space 21 of the housing 20 in addition to the wall areas 22, 23 and 24.

Figure 3:
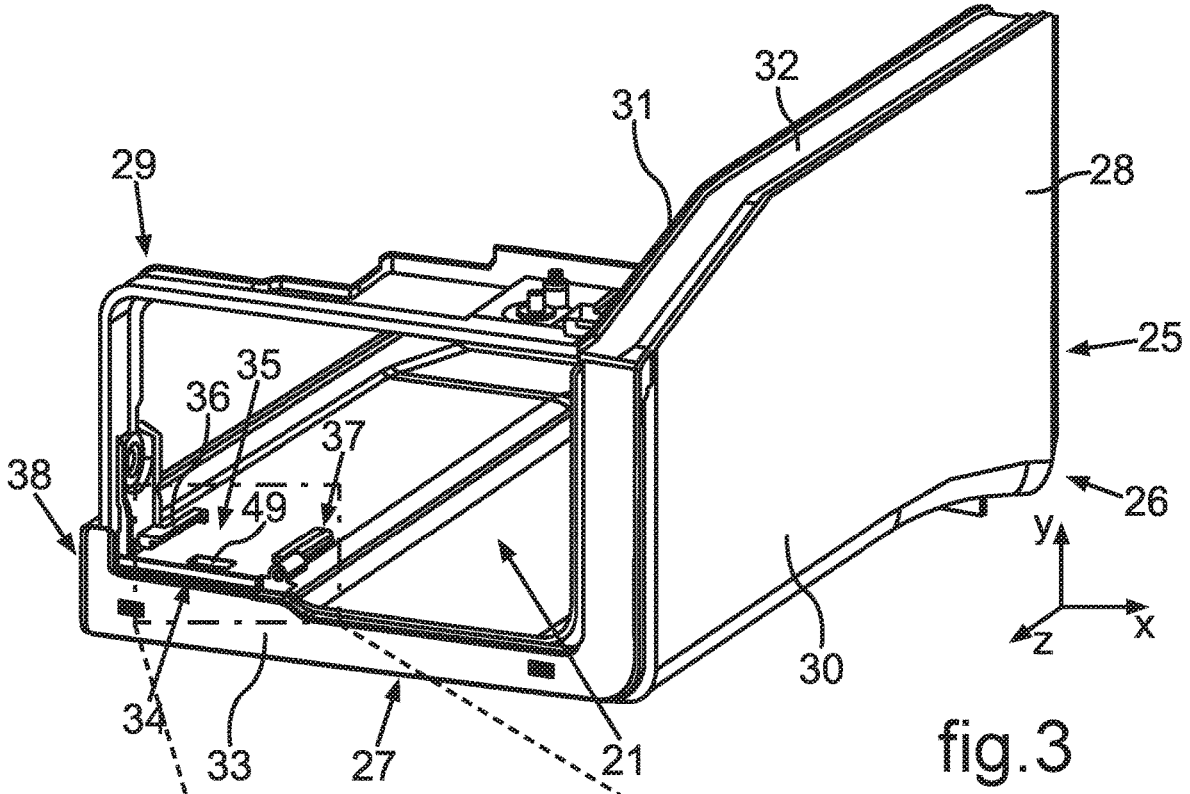
FIG. 3 is a perspective representation of partial components of a housing of an ice maker, as it can be installed in the household refrigeration apparatus according to FIG. 1.

In FIG. 3, the wall unit 25 is shown in a perspective representation. It comprises a first wall plate 27 and a second wall plate 28, which form a plate unit 26. The two wall plates 27 and 28 directly join to each other and in particular at an angle of 90° to each other. The first wall plate 27 is in particular horizontally oriented and the second wall plate 28 is vertically oriented. In a vertical section, in which the sectional plane is formed by the width direction (x-direction) and the height direction (y-direction) of the household refrigeration apparatus 1 and also of the ice maker 11 in this context, this plate unit 26 has an L-shape.

In the shown embodiment, the wall unit 25 also comprises an L-shaped positioning bracket 29. It is connected to the wall plate 28 on the one hand and to the wall plate 27 on the other hand with its ends. In depth direction (z-direction), this positioning bracket 29 is arranged in a front area and thus in a front end of this wall unit 25. It bounds a front-side opening of this wall unit 25 with the front area of the wall plates 27 and 28. The wall plates 27 and 28 are formed with an integral, L-shaped outer wall element 30 and an L-shaped and integral inner wall element 31 separate therefrom. In a clearance between the outer wall element 30 and the inner wall element 31, a thermally insulating material 32 is introduced. Thereby, the receiving space 21 of the ice maker 11 is thermally insulated from the remaining volume of the receiving space 6. A front-side, also L-shaped end flange 33 covers this clearance between the outer wall element 30 and the inner wall element 31 on the front side.

As is apparent in FIG. 3, an assembly area 34 for a drive unit of the ice maker 11 is formed at the first wall plate 27, in particular at the inner wall element 31. The drive unit, which is not yet illustrated in FIG. 3, is formed for moving a flap. An opening can be closed by this flap, from which ice can be output from the housing 20 of the ice maker 11, in particular can be output into the output unit 13.

Components of a mechanically, non-destructively detachable connection 35 are formed in the assembly area 34. The connection 35 can be formed to the effect that it is only formed for directly plugging components together. However, this plug connection can additionally also be formed as a locking connection and a locking can then additionally be provided besides simply plugging together. Thus, a locking connection is in particular also understood by a plug connection.

This connection 35 comprises mating plug elements 36 and 37. These mating plug elements 36 and 37 are in particular formed integrally with the inner wall element 31. The mating plug elements 36 and 37 are formed as plug rails in the embodiment. They are oriented parallel to each other and extend linearly in depth direction. Moreover, it is provided that the assembly area 34 is formed in the front area viewed in depth direction of the housing 21. In particular, this assembly area 34 and thus also the connection 35 to the mating plug elements 36 and 37 is formed in a front third of length of the wall unit 25. This means that these mating plug elements 36 and 37 are formed in a front third of length of this entire length of the wall unit 25 upon length view of the wall unit 25 in depth direction. In particular, the mating plug elements 36 and 37 are thus formed in a front third of length of the housing 21 and thus also of the entire ice maker 11.

In an implementation, it is provided that the mating plug elements 36 and 37 are formed in a corner area 38 with front-side view of the wall unit 25 and thus with view in depth direction. In particular, this corner area 38 is a left-side, lower corner area with this front-side view.

Figure 4:
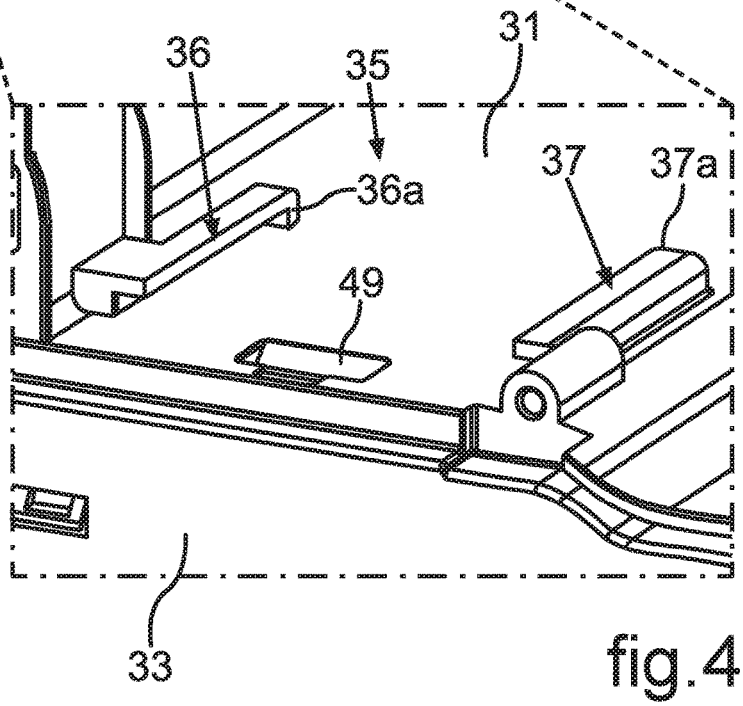
FIG. 4 is an enlarged partial representation of FIG. 3.

In FIG. 4, that partial area of the representation in FIG. 3 is shown enlarged, in which the mating plug elements 36 and 37 are formed. As is apparent, these mating plug elements 36 and 37 each comprise a rear stop 36*a*, 37*a*. These stops 36*a*, 37*a* thus limit the depth of this plug-in length. The plug elements of the plug connection not shown in FIG. 3 and FIG. 4 can be plugged in over this plug-in length and thus be mechanically coupled to these mating plug elements 36 and 37.

Figure 5:
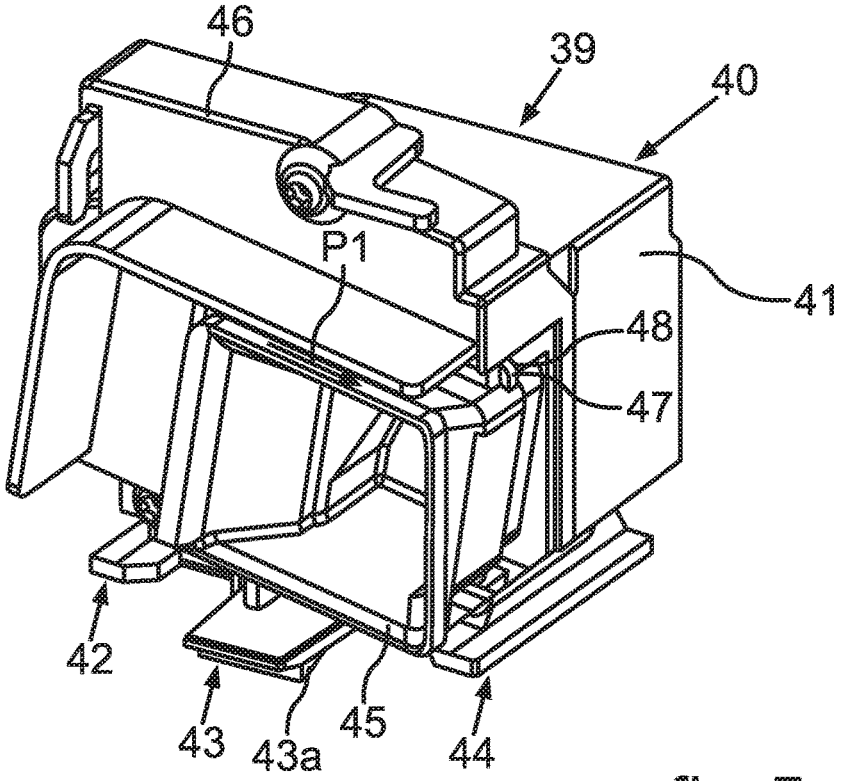
FIG. 5 is a perspective representation of a drive unit of the ice maker.

In FIG. 5, a drive unit 39 of the ice maker 11 is shown in a perspective representation. This drive unit 39 is constructed as a compact module 40. This drive unit 39 comprises a module housing 41. It is in particular formed of plastic. The module housing 41 advantageously comprises plug elements 42, 43 and 44 formed integrally therewith. These separate plug elements 42 to 44 are a further constituent of the plug connection 35. In particular, the plug elements 42, 44 are formed as plug runners in the embodiment.

They are formed in a lower area of the module housing 41.

The drive unit or drive 39 moreover comprises an actuating element or actuator 45. The actuating element 45 is a separate component, which is movably arranged. Here, it is in particular linearly displaceable. Here, the actuating element 45 is arranged obliquely inclined and thus can be moved on an obliquely inclined linear guiding track relative to a retaining unit 46 of the drive unit 39. Here, the actuating element 45 is formed as a duct-like box, so that introduction of the end of the lever rod 58 into the actuating element 45 is simplified while closing of the front cover 50. Further, the end of the closing rod 58 is angled or curved in direction away from the container 56 in order to support guidance of the lever rod 58 into duct-like box of the actuating element 45 while closing of the front cover 50. The direction of movement of the actuating element 45 relative to the retaining unit 46 is shown by the arrow P1.

Further, the actuating element 45 comprises at least one engagement element 47, which is guided in a guiding groove 48 of the retaining unit 46. In particular, an upper engagement element 47 and a lower engagement element 47 as well as an upper guiding groove 48 and a lower guiding groove 48 are formed.

As is moreover apparent in FIG. 3 and FIG. 4, the connection 35 comprises a receptacle 49. The receptacle 49 is formed in the inner wall element 31 and formed between the mating plug elements 36 and 37 viewed in width direction.

Figure 6:
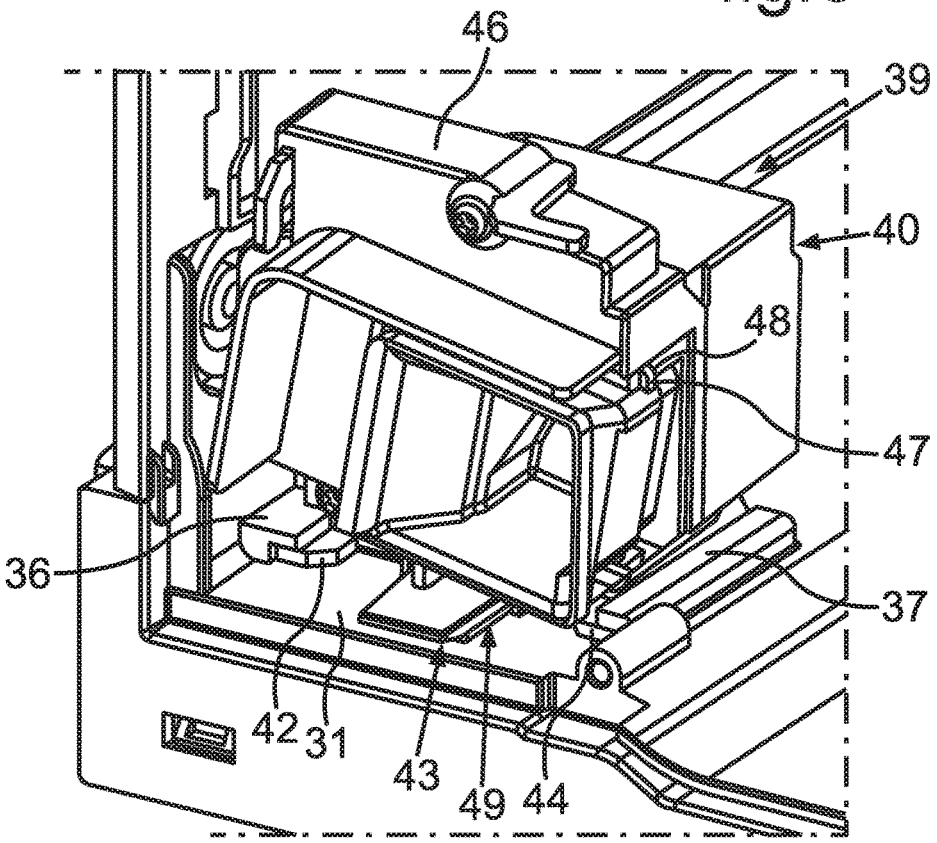
FIG. 6 is a perspective representation of an assembled state of the drive unit according to FIG. 5 in a partial area of the housing according to FIG. 3 and FIG. 4.

In FIG. 6, the assembled state of the module 40 at the wall unit 25 is shown in a perspective representation. Thus, the drive unit 39 is arranged in a front area of the housing 21, in particular in a front third of length of this housing 20. As it is apparent in FIG. 6, a secure retention is achieved by the mechanical coupling of the plug elements 42, 43 to the mating plug elements 36 and 37 and the receptacle 49. In particular, it is provided that the drive unit 39 and thus the module 40 are arranged at the wall unit 25 only by this connection 35. Additional separate fixing elements such as for example screws or the like are not provided.

As is apparent in FIG. 6, the plug element 42 formed as a plug runner is coupled to the mating plug element 36 and inserted into it up to the stop 36*a*. The further plug element 44 formed spaced thereto is inserted into the mating plug element 37, in particular up to the stop 37*a*.

Such a configuration would already be sufficient to allow the secure retention of the module 40 at the wall unit 25. In an advantageous implementation, it is provided that the element 43 is present in addition to these plug elements 42, 44 and the mating plug elements 36 and 37. It is preferably formed with a locking element 43*a*. This locking element 43*a* plunges into the receptacle 49 in the assembled state, as it is shown in FIG. 6, and snaps therein or locks therein. An even better positional fixing of the module 40 at the wall unit 25 is thereby achieved. Thus, secure positioning of the module 40 at the wall unit 25 is in particular achieved in all three spatial directions. In particularly advantageous manner, simple detachment of the module 40 from the assembled final position shown in FIG. 6 is also allowed.

In that the element 43 is actuated at its front-side edge, in particular upward bent, this snapped or locked state can be detached and then the module 40 can be forward pulled by a movement linear viewed in depth direction.

In the assembly, thus, this module 40 is provided and the wall unit 25 is also provided. For assembling this drive unit 39 to the wall unit 25, this module 40 is displaced into the wall unit 25 coming from the front. Thereto, the plug elements 42 and 44 are coupled to the mating plug elements 36 and 37. Upon then guided linear displacement of the module 40 in depth direction to the rear, the plug elements 42 and 44 are moved until they have reached the stops 36*a* and 37*a*. Snapping of the locking element 43*a* in the receptacle 49 is then also automatically achieved on this movement path.

Figure 7:
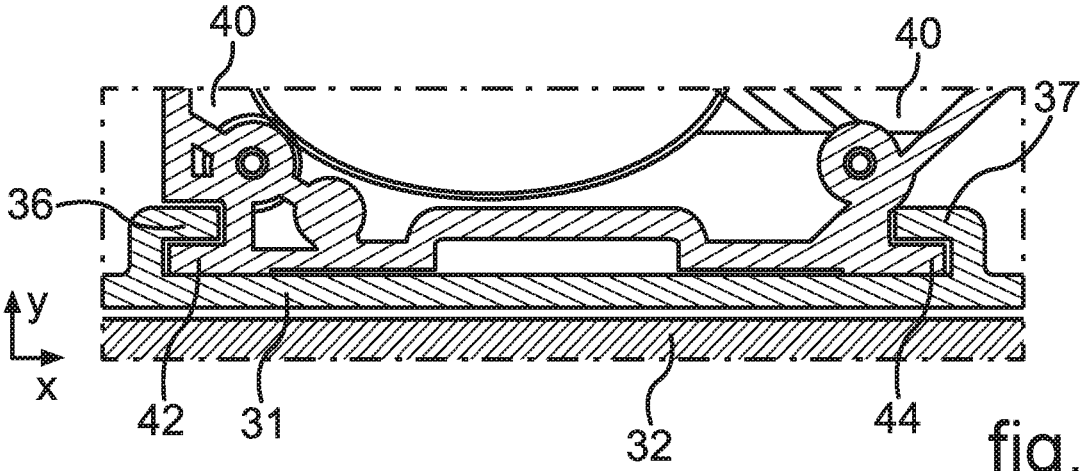
FIG. 7 is a sectional representation through a partial area of the configuration according to FIG. 6.

In FIG. 7, the module 40 is shown in the assembled state in a vertical sectional representation. This vertical section is formed in a rear area of the module 40 such that the snapped state of the locking element 43*a* in the receptacle 49 is not apparent.

Figure 8:
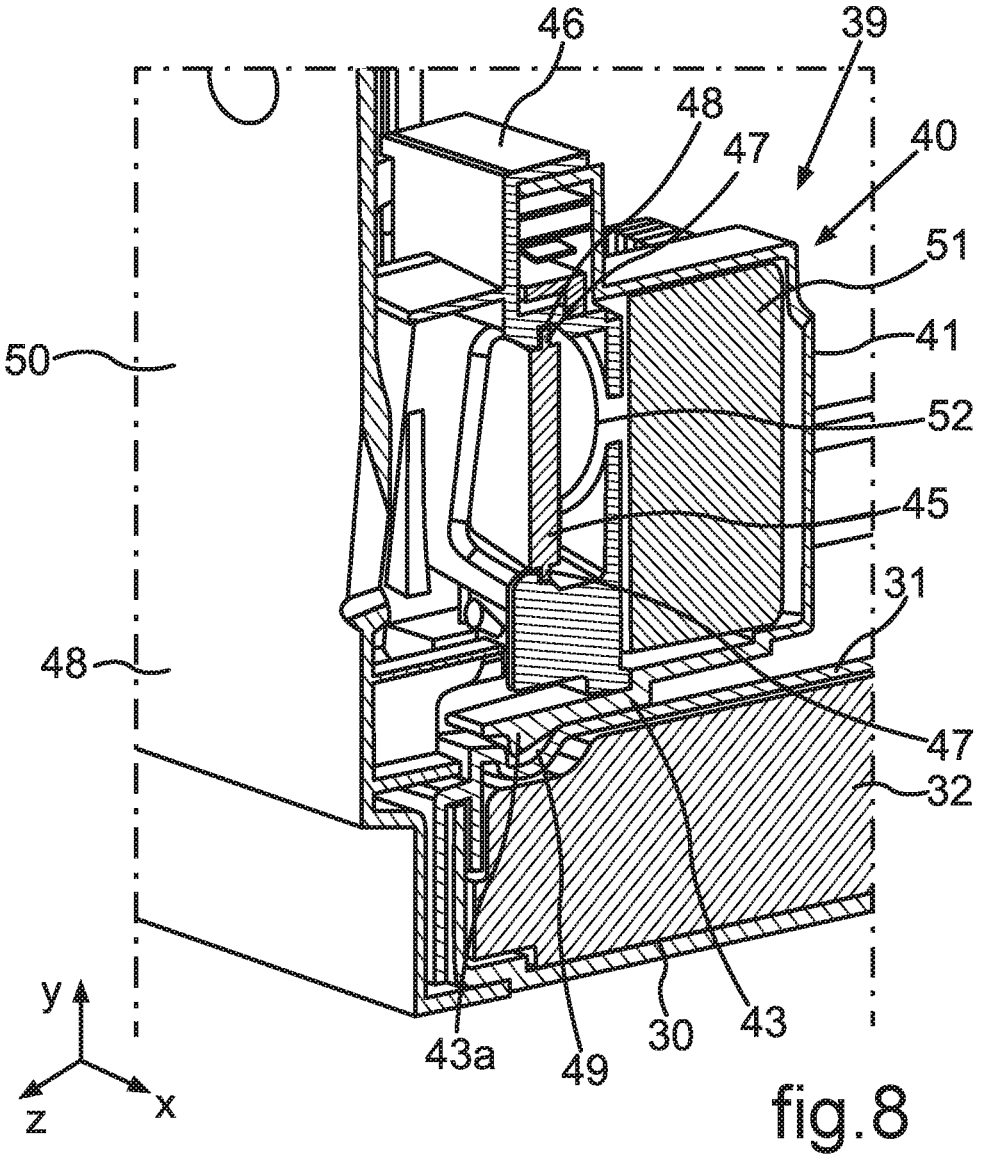
FIG. 8 is a further sectional representation through the configuration according to FIG. 6 with an additionally assembled front cover.

In FIG. 8, the wall unit 25 with the module 40 assembled thereto is shown in a further vertical sectional representation. Here, the sectional plane is given by the height direction and the depth direction. Moreover, the sectional representation in FIG. 8 is also perspectively shown. In contrast to the representation according to FIG. 6, moreover, a front-side cover 50 is additionally illustrated, which represents a front-side frame. The front flange 33 and the positioning bracket 29 are covered on the front side by this cover 50.

In this representation, the snapped state between the locking element 43*a* of the element 43 and the receptacle 49 is shown.

Moreover, it is also apparent that the drive unit 39 comprises a motor 51, which is arranged in the module housing 41. In the embodiment, it is provided that the drive unit 39 moreover comprises a cam 52. The cam 52 is coupled to the motor 51. On the other hand, the cam 52 is coupled to the actuating element 45. The cam 52 is set in a rotational movement by the motor 51. By this rotational movement, the actuating element 45 is actuated. Therein, the coupling between the cam 52 and the actuating element 45 is such that the rotational movement of the cam 52 is converted to a linear movement according to the arrow P1.

Figure 9:
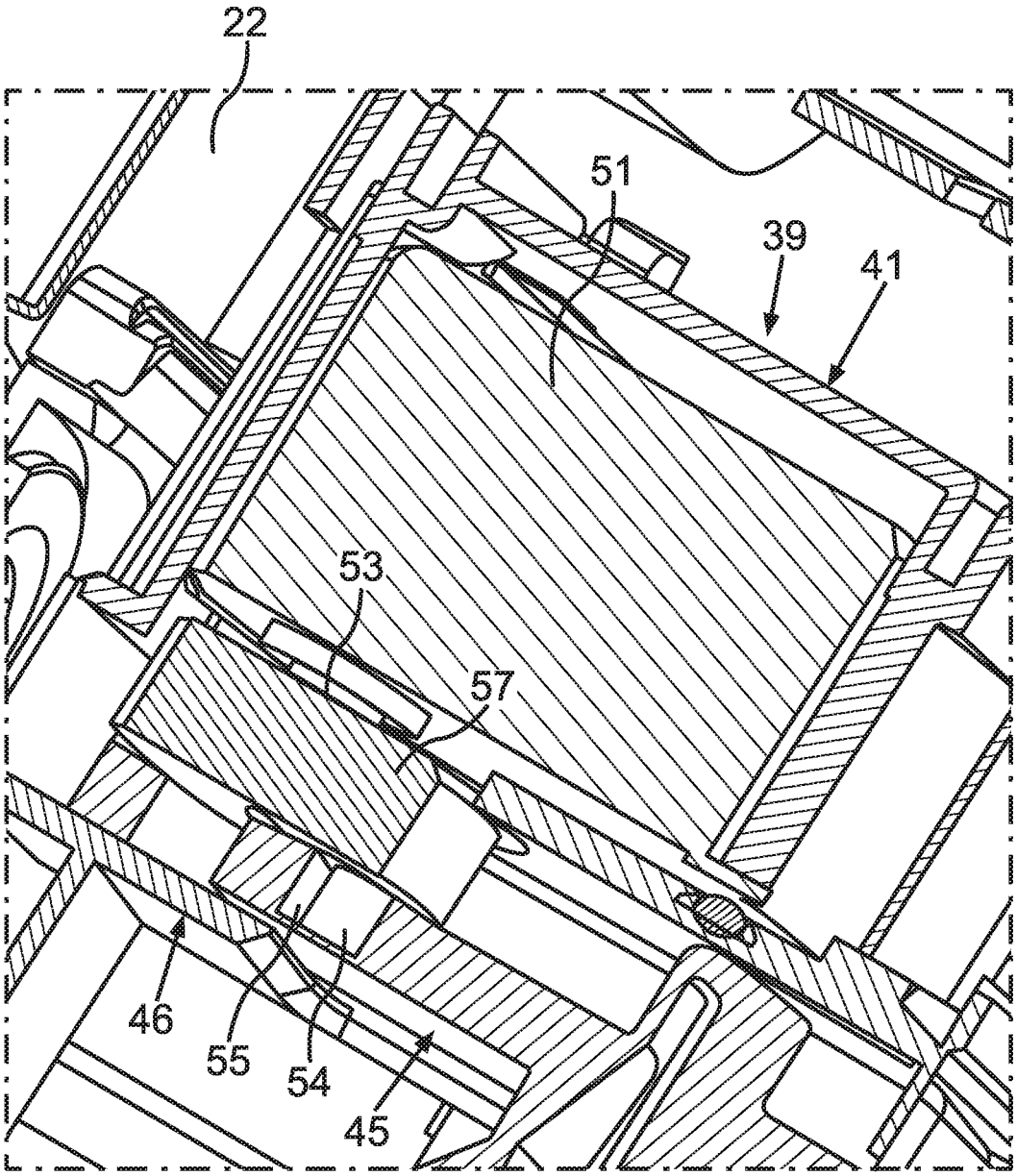
FIG. 9 is a horizontal sectional representation through the assembled drive unit with the representation of specific partial components.

In FIG. 9, the drive unit 39 is shown in a horizontal sectional representation. As is here apparent, a shaft 53 of the motor 51 engages with the cam 52. The cam 52 comprises a pin-like coupling element 54, which engages with a receptacle 55 of the actuating element 45.

Figure 10:
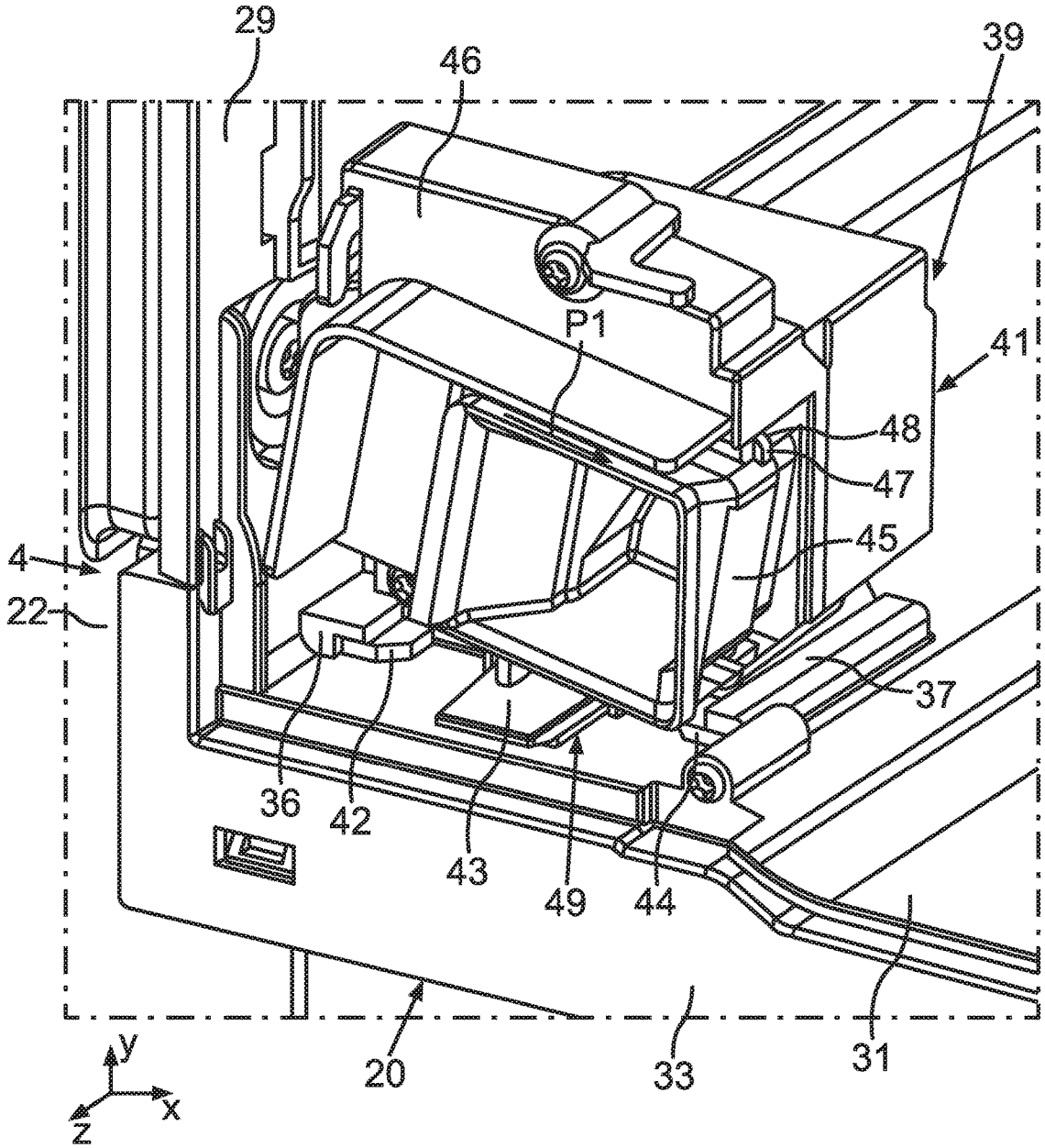
FIG. 10 is a further perspective representation, in which the configuration according to FIG. 6 is installed in the interior container of the household refrigeration apparatus.

In FIG. 10, the housing 20 of the ice maker 11 is shown in a further perspective representation. Therein, the wall unit 25 is assembled to the interior container 4 in the upper left corner area. In particular, the actuating element is also guided in the lower area by the coupling between a guiding groove or guiding track 48 and an engagement element 47, as it is shown in FIG. 8.

Figure 11:
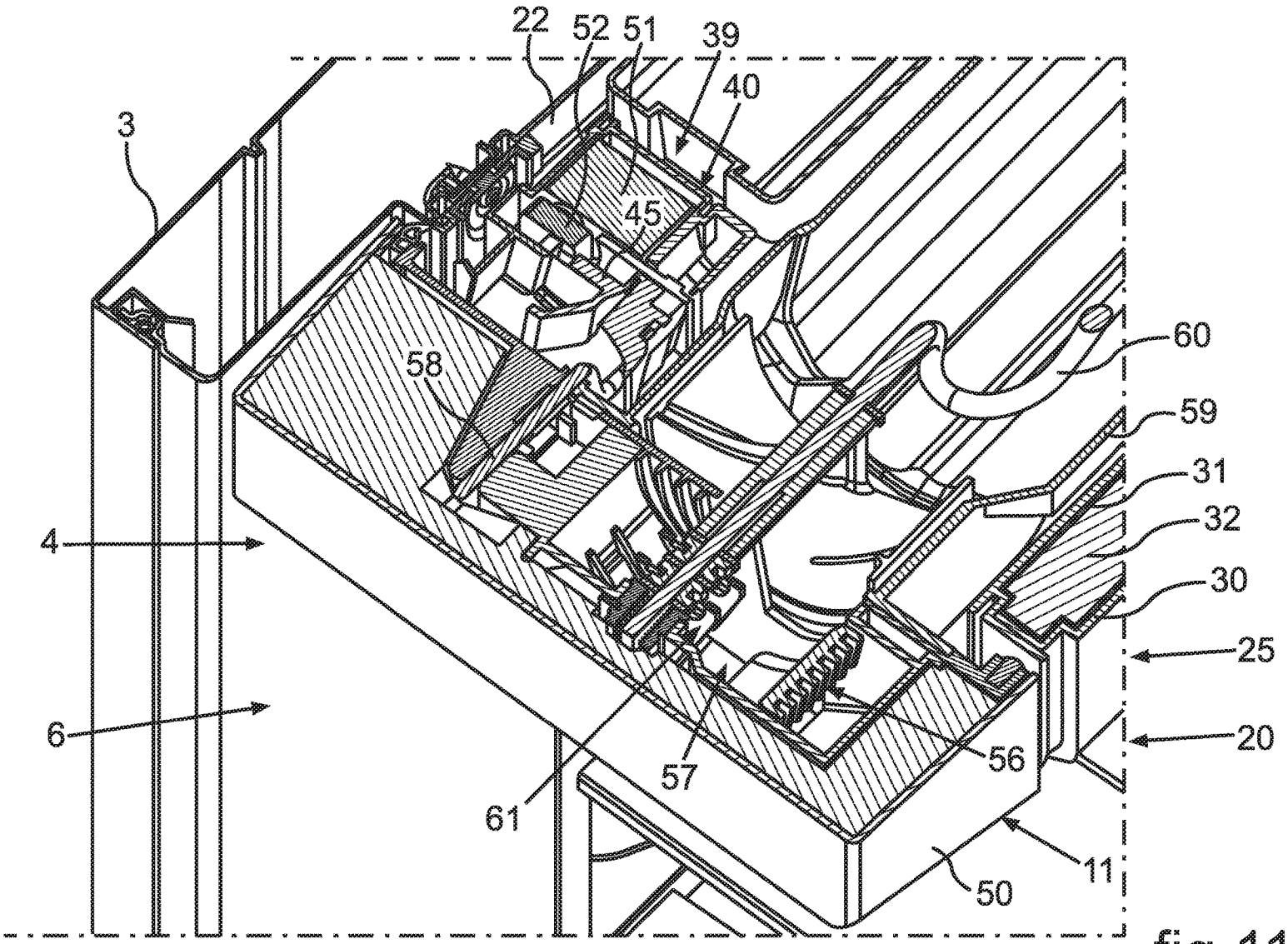
FIG. 11 is a horizontal sectional representation through the household refrigeration apparatus in the area of the ice maker.

In FIG. 11, a partial area of the household refrigeration apparatus 1 is illustrated in a horizontal sectional representation (the sectional plane is formed by the width direction and the depth direction). The ice maker 11 is shown in the installed state in the household refrigeration apparatus 1. As is apparent, the module 40 is arranged in a near area to a flap 56. The flap 56 is an ice flap, which closes or unblocks an opening 57 of the housing 20. The flap 56 is movably arranged and movable by the drive unit 39. The flap 56 is movably arranged at the opening 57 and switchable between a closed position for dispensing of crushed ice and an opened position for dispensing of uncrushed ice through the opening 57. That means, that the flap 56 is switchable between a closed position in which the opening 57 is partly closed, so that the crushed ice can fall through the opening, and a opened position in which the opening 57 is completely opened, so that uncrushed or cubed ice can fall through the remaining opened area of the opening 57.

As is in particular apparent in FIG. 11, this flap 56 is arranged in a front area of the ice maker and thus also of the housing 20. The module 40 is arranged directly adjacent to this flap 56, which is preferably also located in the front third of the length of the housing 20 measured in depth direction. By this immediately adjacent arrangement between the module 40 and the flap 56, very short paths arise, to be able to actuate this flap 56 by the drive unit 39 via mechanical coupling. As is apparent in this context, the ice maker 11 comprises a very short lever rod 58. This lever rod 58 is directly connected to the actuating element 45. On the other hand, this lever rod 58 is connected to the flap 56.

In the representation according to FIG. 11, a container or a collecting pan 59 is furthermore shown. The produced ice form elements, in particular the ice cubes, can be stored in the ice maker 11 in this collecting pan 59 until they can be transported out of the housing 20. Thereto, a screw conveyor 60 is provided. The ice form elements can be transported forward into the collecting pan 59 viewed in depth direction by this screw conveyor 60 until they get into the opening 57. If it is to be provided that these ice form elements are crushed and for example crushed ice is produced, these ice form elements are crushed by a crushing device 61, which is arranged adjacent to the opening 57.

The flap 56 is opened or closed depending on need such that the ice form elements or the crushed ice can be output via the opening 57.

As is moreover apparent in FIG. 11, the module 40 is arranged next to this collecting pan 49 viewed in width direction (x-direction). Thus, the module 40 is arranged directly adjacent and lateral to this collecting pan 59 viewed in width direction. Viewed in depth direction, the module 40 is arranged overlapping with the collecting pan 59 in particular over its entire length. Thereby, a compact construction of the housing 20 is achieved in depth direction.

Figure 12:
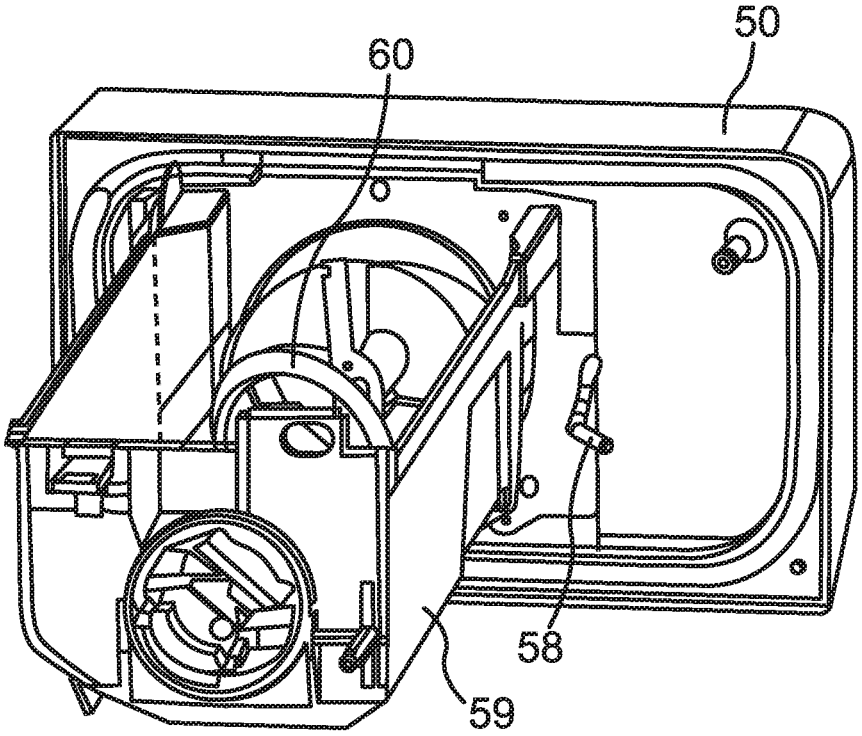
FIG. 12 is a perspective view from behind to partial components of the ice maker.

In FIG. 12, an arrangement of multiple components of the ice maker is shown in a perspective representation viewed from behind. The lever rod 58 is shown.

Figure 13:
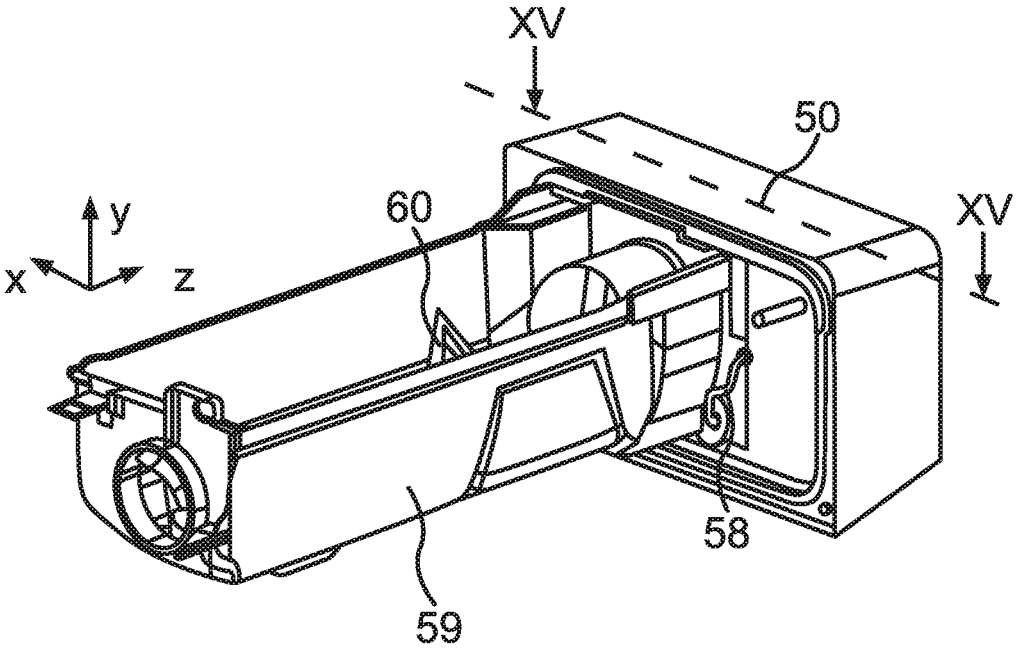
FIG. 13 is the representation according to FIG. 12 in a perspective different from FIG. 12.

In FIG. 13, the configuration of the components according to FIG. 12 is shown in a perspective different from FIG. 12.

Figure 14:
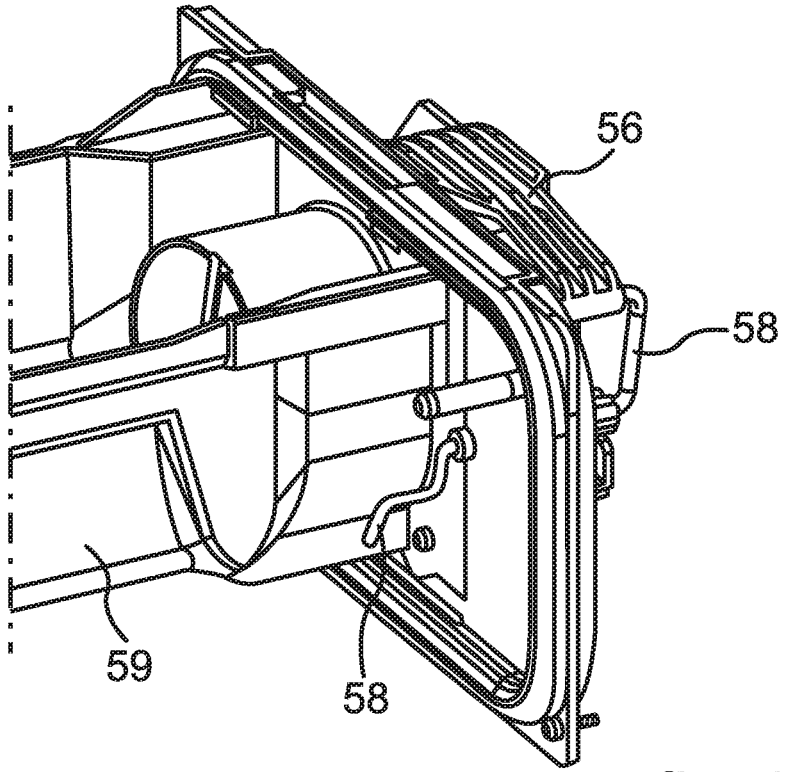
FIG. 14 is an enlarged representation of partial components of the arrangement in FIG. 13.

In FIG. 14, partial elements of the representation in FIG. 13 are shown, wherein the front cover 50 is removed hereto. Here, the flap 56 is shown with its upper area. The lever rod 58 is also illustrated.

Figure 15:
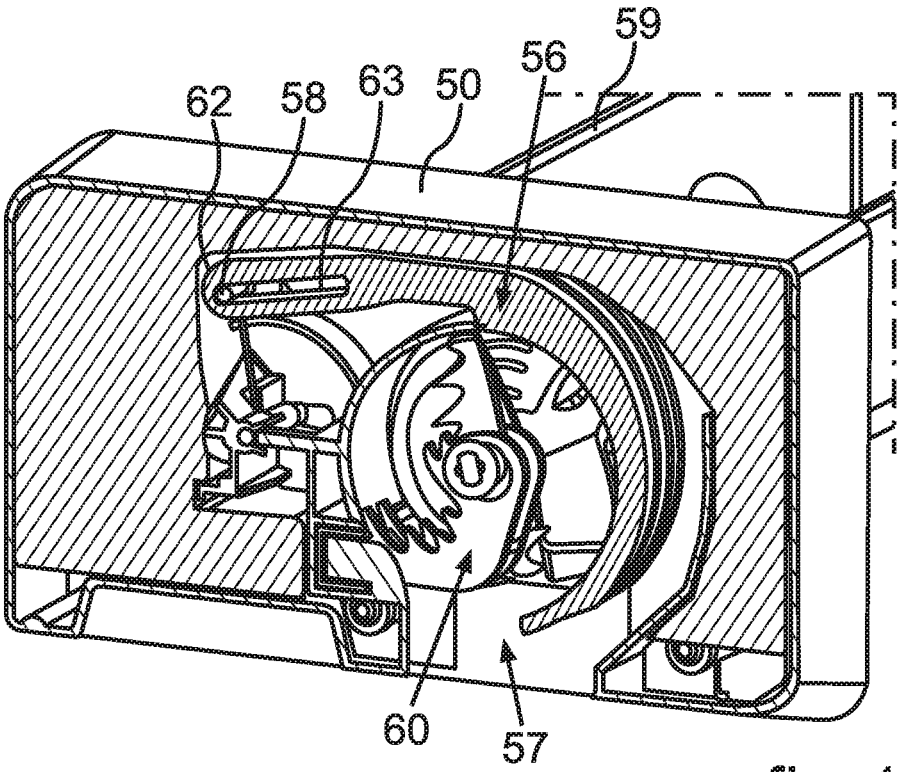
FIG. 15 is a perspective vertical sectional representation through the arrangement of the components according to FIG. 13.

In FIG. 15, the arrangement is shown in a perspective sectional representation along the sectional line XV-XV in FIG. 13. This flap 56 comprises a receptacle 63 at its end portion 62 facing away from the opening 57 and facing the module 40. The lever rod 58 engages with this receptacle 63. In particular, this receptacle 63 is formed as an elongated hole or an engagement slit. By the movement transmission of the movement of the cam 52 to the actuating element 45, the lever rod 58 coupled thereto is actuated, in particular rotated, such that by the coupling of the lever rod 58 to the flap 56, this flap 56 is moved between the opened position and the closed position.

Figure 16:
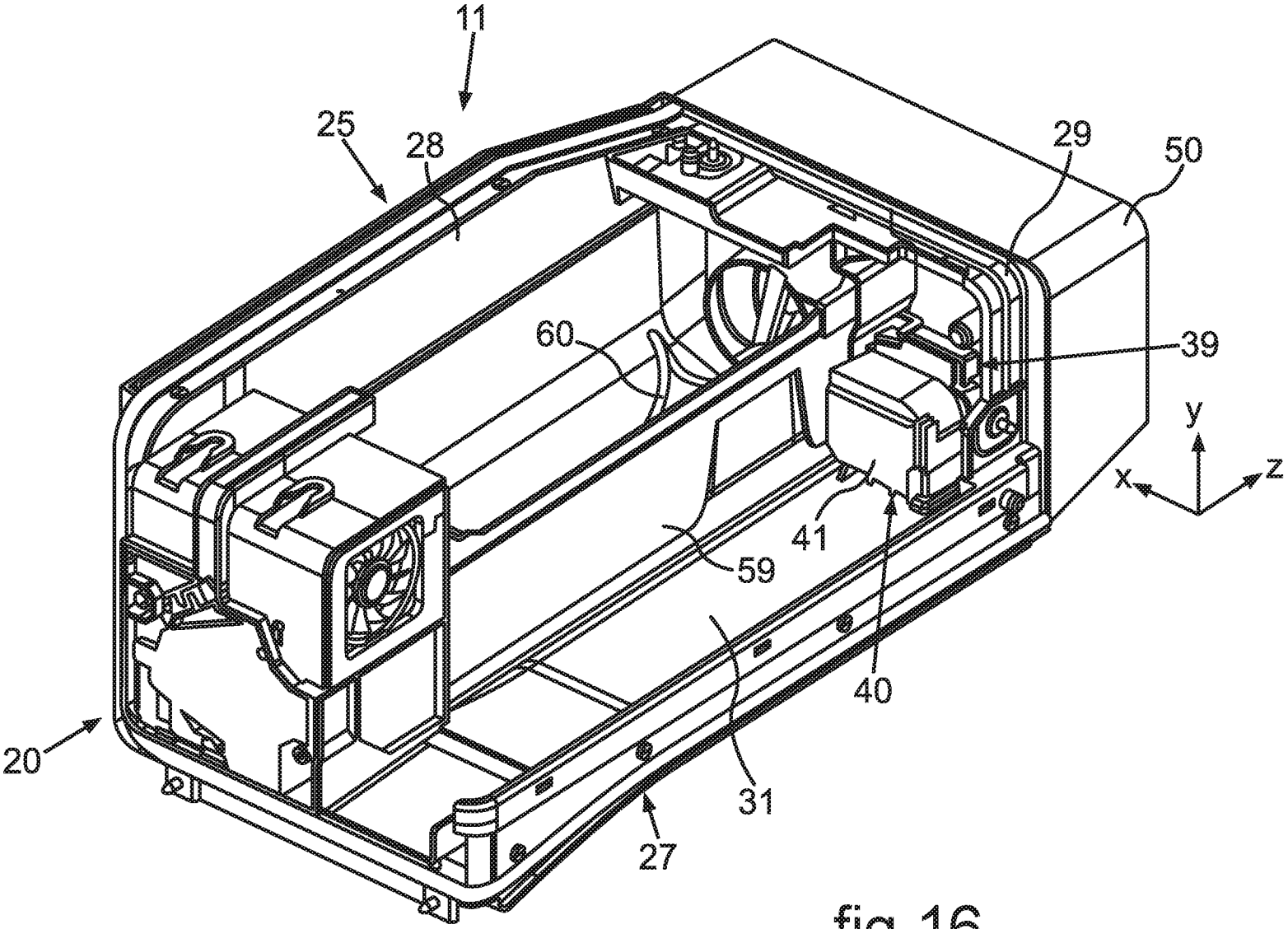
FIG. 16 is a perspective representation to partial components of the ice maker.

In FIG. 16, the ice maker 11 is shown with partial components. These partial components are shown in a perspective representation with view from behind. In this perspective representation, the front-side position of the entire module 14 immediately in the near area to the flap 56 is apparent. Here, the arrangement of the module 40 in the front third of length of the length of the housing 20 measured in depth direction is in particular also apparent.

Figure 17:
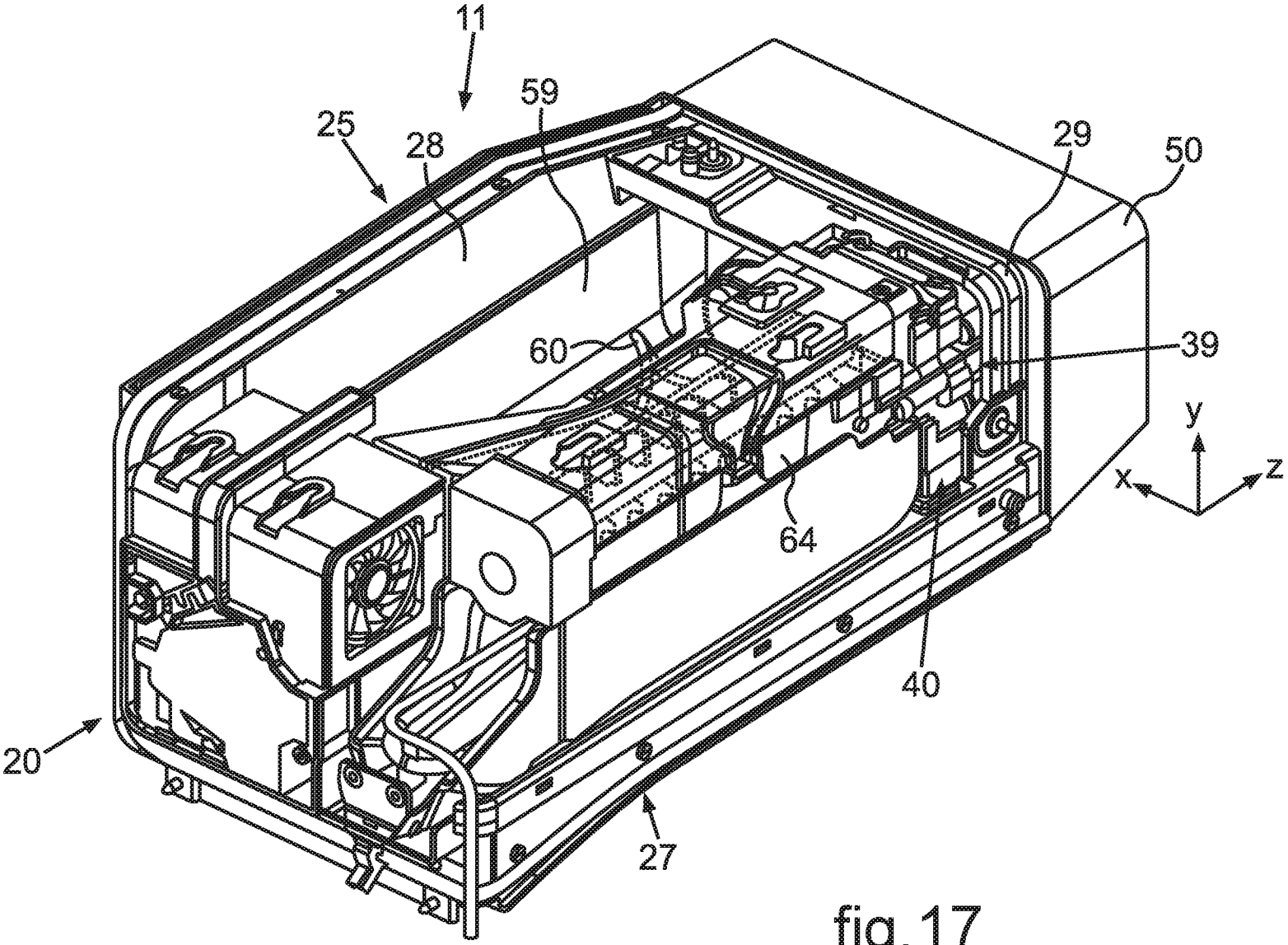
FIG. 17 is a representation according to FIG. 16 with additionally assembled components of the ice maker.

In FIG. 17, the representation according to FIG. 16 is shown, wherein additional further components of the ice maker 11 are installed in the housing 20 in FIG. 17. In particular, this is an ice form tray 64, into which water can be introduced. The water introduced into form areas of this ice form tray 64 freezes. The thus produced ice form elements can then be removed from the ice form tray 64 and be introduced into the collecting pan 59. In particular, the lever rod 58 is a coupling rod. The coupling rod is in turn a constituent of a coupling device or coupler, by which the drive unit 39 is mechanically coupled to the flap 56.

Figure 18:
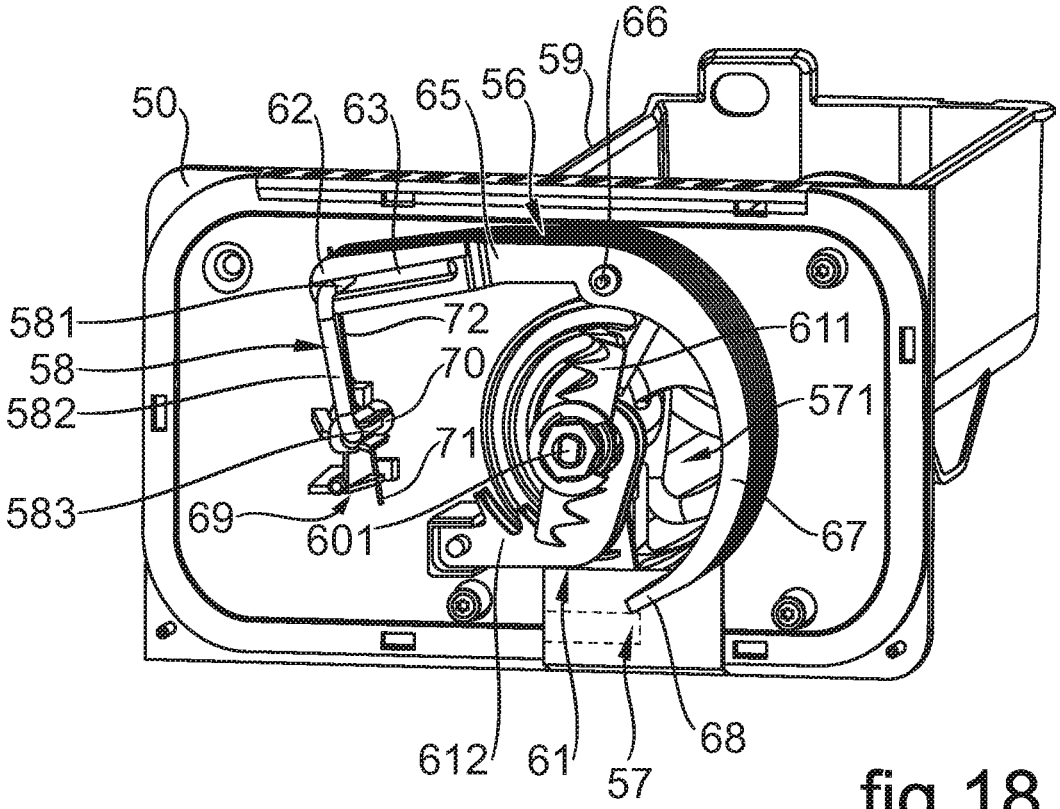
FIG. 18 is a further representation according to FIG. 15 in a closed state of the flap.

In FIG. 18, the representation of FIG. 15 is shown, wherein the flap in a closed position. In the closed position of the flap 56 it is prevented that untreated ice stored in the ice container 59, which is conveyed to the crushing device 61 by operation of the screw conveyer 60, is dispensed through the opening 57. In the closed position of the flap 56, in which the flap 56 partly closes the opening 57, the stored ice in the container 59 cannot bypass the crushing device 61 or falling down through the opening 57 and is conveyed into the crushing device 61. In the closed position of the flap 56 only crushed ice by the crushing device 61 can be dispensed through the opening 57. The crushing device 61 comprises fixed blades 612 and rotating blades 611 which having crushing teeth on edge surfaces which facing each other in the installed state and in rotating movement the teeth of the blades 611, 612 faces each other. The rotating blades 611 are coupled with the shaft 601 and, in operation, the rotating blades 611 rotate in the same direction as the screw conveyer 60. The fixed blades 612 are coupled loosely with the shaft 601 of the screw conveyer 60, so that, in operation, the shaft 601 or the screw conveyer 60 is able to rotate relative to the fixed blades 612, and coupled firmly with a wall of the cover 50. The rotating blades 611 and the fixed blades 612 are arranged offset and alternately in longitudinal direction of the screw conveyer 60 and, in operation, the rotating blades 611 carries the ice to the fixed blades 612 and breaks it at the teeth by rotating through a gap between adjacently arranged fixed blades 612. In operation of the screw conveyer, which is initiated by customer request for ice, and in closed position of the flap 56, the stored ice in the ice container can only take the way through the crushing device 61 and falls through the remaining opened area of the opening 57 provided directly below the crushing device 61.

In the installed state, the flap 56 extends around the crushing device 61, in particular extends a first flap arm 65 above the crushing device 61 in width direction of the ice maker 20 and a second flap arm 67 extends downwardly in height direction of the ice maker 20 along a right side, in front view of the ice maker 20, of the crushing device 61. This flap 56 comprises a pivot axis 66 between the first flap arm 65 and the second flap arm 67 about which the flap 56 rotates between the closed position to the opened position and vice versa. The pivot axis 66 is preferably provided above the crushing device 61 and from the pivot axis 66 extends horizontally away the first flap arm 65 of the flap 56 in direction of the coupling rod 58 or module 40 and the second flap arm 67 of the flap 65 extends downwardly away in direction of the opening 57. At the first flap arm 65 is provided a first end portion 62 of the flap 56 at which a receptacle 63, or engagement slit or elongated hole, is provided. In the installed state, the coupling rod 58 engages with the receptacle 63, in particular the end portion 581 of the coupling rod 58 protrudes into the elongated hole or engagement slit of the receptacle 63 and is movable therein. The first flap arm 65 is substantially formed straight. The second flap arm 67 of the flap 56 faces away from the module 40 and facing the opening 57. The second flap arm 67 is formed shovel-like and/or is curved and extending in height direction of the ice maker 11 from the pivot axis 66 around or along the container opening 571 in direction of the opening 57. The second flap arm 67 having a second end portion 68 of the flap 56 which rotates in or rotates out of the area of the opening 57. The arrangement of the pivot axis 66 enables a rocket function, so that a drive unit 39 can be provided with less power for causing the rotating movement of the flap 56. Further, the configuration of the flap 56 allows close arrangement of the drive unit 39 to the opening 57, so that the place inside the housing can be utilized optimally.

The coupling rod 58 or lever rod having a main part 583, a middle part 582 and an end part 581 which are formed from metal and formed in one part. The middle part 583 connects the end part 581 with the main part 583 and the middle part is provided orthogonally to the end part 581 and main part 583. The end part 581, middle part 582, and main part 583 having a U-shape and both the main part 583 and the end part 581 extend parallel to the longitudinal axis of the shaft 601 of the screw conveyor 60.

At the main part 583 of the coupling rod 58 is arranged a spring 70. This spring 70 is preferably a coil spring or spiral spring. The spring 70 having a center portion which is coiled around a rotating axis of the coupling rod 58. The center portion of the spring 70 is provided either loosely coiled around the main part 583 or a sleeve protruding from the wall of the cover 50 through which the lever rod 58 protrudes. From the center portion of the spring 70 extends radially away a first spring arm 71 and second spring arm 72. The first spring arm 71 extends downwardly in height direction of the ice maker 20 and is coupled with a protrusion 69 provided at a wall of the front cover 50. The first spring arm 71 may be disposed in a groove of the protrusion 69. The second spring arm 72 extends upwardly from the center portion to the first end part 581 and is coupled or in contact with the end part 581, in particular the second spring arm 72 is loosely coiled around the first end part 581 which protrudes out from the engagement slit on the side of the first flap arm facing ice container 59. In this representation, the coupling of the second spring arm 72 with the end part 581 is hidden by the flap 56. The spring 70 in this representation at least slightly pre-tensed, so that the flap 56 is always pressed with a specific force into the closed position. By the movement transmission of the movement of the cam 52 to the actuating element 45, the lever rod 58 coupled thereto is actuated, in particular rotated, such that by the coupling of the lever rod 58 to the flap 56, this flap 56 is moved between the closed and opened position. In particular, due to the scope of movement of the coupling rod 58 inside the actuation element 45 or inside the duct-like box of the actuating element 45 and small movement of the drive unit 39, the drive unit 39 does not facilitate the closed or at least a completely closed position of the flap 56, so that the return movement of the flap 56 from the opened position into the closed position is facilitated partly or completely by the spring 70.

In order to move the flap 56 into the opened position, the lever rod 58 is rotated clockwise by the drive unit 39 and by this movement the first flap arm 65 is pushed downwardly or in direction of the opening 57 by the coupling rod 58. Thereby, the end part 581 moves closer to the pivot axis 66 inside the elongated hole of the receptacle 63 and the second flap arm 67 rotates counter-clockwise away from the opening 57 about the pivot axis 66 until the lever rod 58 is in contact with the other end of the elongated slit of the receptacle 63 which is closer to the pivot axis 66 or the drive unit 39 has reached the stop position.

Figure 19:
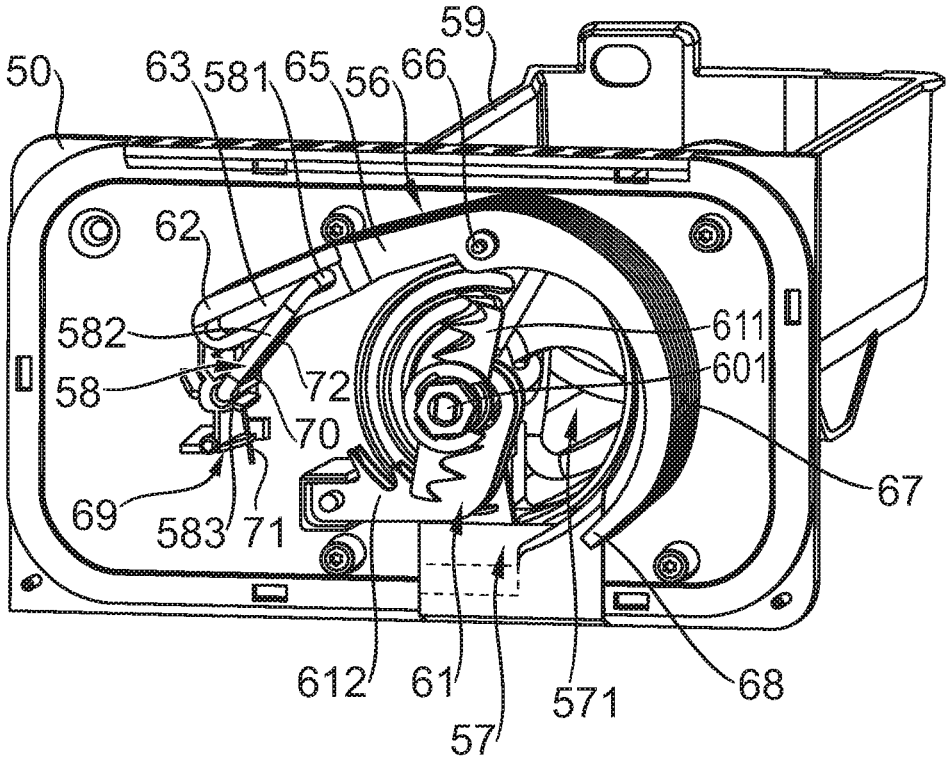
FIG. 19 is a further representation according to FIG. 15 in an opened state of the flap.

In FIG. 19, the representation of FIG. 15 is shown, wherein the flap is provided in an opened position. In the opened position of the flap 56, the second end portion 68 is pivoted counter-clockwise away from the opening 57 or out of the opening 57 about the pivot axis 66, so that the opening 57 is completely free and the ice conveyed to the opening 57 can be uncrushed dispensed through the opening 57 by bypassing the crushing device 61. Further, the coupling rod 58 is rotated in direction of the opening 57 or clockwise and the end part 581 of the lever part 58 moves along the elongated hole 63 closer to the pivot axis 66 of the flap 56. Thereby, the first end portion 62 or the first flap arm 65 of the flap 67 is pushed downwardly by a clockwise rotation of the lever rod 58 and the second end portion 68 or the second flap arm 67 rotates away from the opening 57, so that the opening 57 is increased and the stored ice can bypass the crushing device 61 or falling through the opening 57 before reaching or coming into contact with the crushing device 61. The second spring arm 70 rotates with the lever rod 58, whereby the spring 70 is loaded or more tensed in the opened position of the flap 56.

In order to rotate the flap 56 back to the closed position, the lever rod 58 is rotated counter-clockwise, driven by the drive unit 39 and/or the tensed spring 70, and the first flap arm 65 is pushed upwardly by the lever rod 58, which moves away from the pivot inside the elongated hole of the receptacle 63, and the second flap arm 67 moves clockwise about the pivot axis 66 relative to the opening 57 or into the opening 57 until the lever rod 58 is in contact with the end of the receptacle 63 which end of the elongated hole of the receptacle 63 is farther away from the pivot axis 66.

LIST OF REFERENCE CHARACTERS

1 Household refrigeration apparatus
2 housing
3 exterior housing
4 interior container
5 clearance
6 receiving space
7 door
8 door
9 receiving space
10 door
11 ice maker
12 dispenser unit
13 output unit
14 front side
15 side wall
16 side wall
17 rear wall
18 bottom wall
19 ceiling wall
20 housing
21 receiving space
22 wall area
23 wall area
24 wall area
25 wall unit
26 plate unit
26 wall plate
28 wall plate
29 positioning bracket
30 outer wall element
31 inner wall element
32 thermally insulating material
33 end flange
34 assembly area
35 plug connection
36 mating plug element
**36*a*** stop
37 mating plug element

37*a* stop
38 corner area
39 drive unit
40 module
41 module housing
42 plug element
43 plug element
43*a* locking element
44 plug element
45 actuating element
46 retaining unit
47 engagement element
48 guiding groove
49 receptacle
50 cover
51 motor
52 cam
53 shaft
54 coupling element
55 receptacle
56 flap
57 opening
571 container opening
58 coupling device
581 end part
582 middle part
583 main part
59 ice container
60 screw conveyor
601 shaft
61 crushing device
611 movable blade
612 fixed blade
62 first end portion
63 receptacle
64 ice form tray
65 first flap arm
66 pivot axis
67 second flap arm
68 second end portion
69 protrusion
70 spring
71 first spring arm
72 second spring arm

The invention claimed is:

1. An ice maker for a household refrigeration apparatus, the ice maker comprising:

a housing having an interior and an opening through which ice is dispensable from said interior out of said housing;

a crusher for crushing ice provided at said opening;

a flap movably disposed at said opening and switchable between a closed position for dispensing crushed ice and an opened position for dispensing uncrushed ice through said opening, said flap having a spring for returning said flap into said closed position;

a drive; and a coupler coupling said drive to said flap for moving said flap, a center portion of said spring being disposed at a rotation axis of said coupler;

said flap having a pivot axis about which said flap pivots, said flap having first and second flap arms, said pivot axis being between said first and second flap arms, said first and second flap arms extending from said pivot axis in different directions, said first flap arm being coupled to said coupler and said second flap arm being movable relative to said opening.

2. The ice maker according to claim 1, wherein said first flap arm extends above said crusher in width direction of said ice maker and said second flap arm extends adjacent to said crusher in height direction of said ice maker.

3. The ice maker according to claim 1, wherein said first flap arm extends axially, said second flap arm is curved and said first and second flap arms are formed as one part.

4. The ice maker according to claim 3, wherein said coupler has a coupling rod which couples said flap and said drive, and said coupling rod protrudes through a wall of a front cover of said ice maker.

5. The ice maker according to claim 4, wherein said flap has an engagement slit extending along a straight line and being formed in a first end portion of said first flap arm, and said coupling rod engages in said engagement slit.

6. The ice maker according to claim 5, wherein an end part of said coupling rod is movable along said engagement slit.

7. The ice maker according to claim 1, wherein said pivot axis is disposed above said crusher.

8. The ice maker according to claim 1, wherein said second flap arm is located inside said opening in said closed position of said flap and outside of said opening in said opened position of said flap.

9. The ice maker according to claim 1, wherein said second flap arm has a curved shovel shape.

10. The ice maker according to claim 1, wherein said spring has a first spring arm extending radially away and downwardly from said center portion and said first spring arm is coupled with a protrusion of a wall of a front cover of said ice maker.

11. The ice maker according to claim 1, wherein said spring has a second spring arm extending radially away and upwardly from said center portion and said second spring arm is coupled with an end part of said coupler.

12. The ice maker according to claim 1, wherein said spring is more tensed in said opened position than in said closed position of said flap.

13. The ice maker according to claim 1, which further comprises an ice container, said coupler having a further end part coupled with said drive, said further end part being angled away from said ice container.

14. The ice maker according to claim 1, which further comprises an ice container, said housing having a front cover to which said ice container is integrally formed, said opening and said flap being provided inside said front cover of said housing.

15. The ice maker according to claim 1, wherein said drive is formed as a separate module, and said module of said drive is disposed entirely adjacent to said opening inside said housing.

16. The ice maker according to claim 15, which further comprises an ice container, said ice container and said module of said drive being disposed laterally directly next to each other inside said housing.

17. The ice maker according to claim 1, wherein said drive includes a motor and an actuator coupled to said motor, said actuator being coupled to said flap.

18. A household refrigeration apparatus, comprising:

an apparatus housing having a receiving space for food; and an ice maker including:

an ice maker housing having an interior and an opening through which ice is dispensable from said interior out of said housing;

a crusher for crushing ice provided at said opening;

a flap movably disposed at said opening and switchable between a closed position for dispensing crushed ice and an opened position for dispensing uncrushed ice through said opening, said flap having a spring for returning said flap into said closed position;

a drive; and a coupler coupling said drive to said flap for moving said flap, a center portion of said spring being disposed at a rotation axis of said coupler;

said flap having a pivot axis about which said flap pivots, said flap having first and second flap arms, said pivot axis being between said first and second flap arms, said first and second flap arms extending from said pivot axis in different directions, said first flap arm being coupled to said coupler and said second flap arm being movable relative to said opening.

* * * * *